US007316150B1

(12) United States Patent
Genereux et al.

(10) Patent No.: US 7,316,150 B1
(45) Date of Patent: Jan. 8, 2008

(54) IMPACT REDUCTION APPARATUS FOR STRETCH DRAW DIES

(75) Inventors: Christian Genereux, Dearborn Heights, MI (US); Joseph Fornasiero, Brighton, MI (US); Evangelos Liasi, Royal Oak, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 11/557,206

(22) Filed: Nov. 7, 2006

(51) Int. Cl.
*B21J 9/18* (2006.01)

(52) U.S. Cl. ..... 72/452.8; 72/452.1; 72/350

(58) Field of Classification Search ..... 72/350, 72/351, 452.1, 452.2, 452.6, 452.7, 453.13, 72/482.1, 482.2, 482.3, 482.4, 482.5, 455
See application file for complete search history.

(56) References Cited

U.S. PATENT DOCUMENTS 3,509,785 A 5/1970 Fuchs, Jr.
3,858,427 A 1/1975 Euteneuer et al.
3,879,974 A 4/1975 Biddell et al.
4,570,474 A * 2/1986 Tanaka et al. ..... 72/411
5,272,898 A 12/1993 Dittlo et al.
6,000,271 A 12/1999 Olsson et al.
6,006,576 A 12/1999 Genseberger et al.
6,016,680 A 1/2000 Matsuoka
6,675,621 B2 1/2004 Kleber
6,820,449 B2 11/2004 Seifert et al.
7,004,007 B2 2/2006 Kruger et al.
2005/0126242 A1 6/2005 Kruger et al.

* cited by examiner

*Primary Examiner*—Derris H. Banks
*Assistant Examiner*—Debra Wolfe
(74) *Attorney, Agent, or Firm*—Raymond L. Coppiellie; Brooks Kushman P.C.

(57) ABSTRACT

An accelerator cam set is provided that initiates movement of a binder ring against the force of spring elements, such as nitrogen cylinders. The accelerator cam set is engaged by a ram cam block that engages a transverse cam block that is moved transversely, or horizontally, into engagement with a binder cam block. The accelerator cam set may be used with a stretch draw die, double pad stretch draw die, or inverted toggle die.

19 Claims, 4 Drawing Sheets

IMPACT REDUCTION APPARATUS FOR STRETCH DRAW DIES

BACKGROUND OF THE INVENTION

1. Field of the Invention

The present invention relates to stretch draw sheet metal presses and dies.

2. Background Art

Sheet metal parts may be initially formed in a draw press that draws a sheet metal blank into the general shape of the part to be produced. Toggle draw presses have a stationary lower die that is engaged by an upper binder ring that encircles an upper draw punch. The upper draw punch draws the sheet metal panel into a cavity defined by the lower die while the binder ring retains the peripheral edges of the sheet metal blank.

Sheet metal drawing processes may also be performed with stretch draw dies that include an upper die that engages a lower binder that is disposed around a lower draw post. The upper die clamps the sheet metal blank on the lower binder ring and then moves the lower binder ring against the force of a spring mechanism such as a set of nitrogen cylinders, an air pad, or a mechanical spring. Nitrogen cylinders may provide up to a hundred tons of pressure in stretch die forming operations. The upper die continues to draw the sheet metal panel by stretching it over the stationary lower draw post. Other versions of the stretch draw die include a double pad stretch draw die and an inverted toggle die. Both the double pad stretch draw die and the inverted toggle die have a lower binder ring that is driven in the course of the press cycle against the spring mechanism that supports the lower binder while the upper die stretches the sheet metal blank over the lower draw post.

Stretch draw dies offer higher productivity and also offer increased capacity to form high strength alloys that are not easily formed in a conventional toggle draw die. High strength sheet metal parts made of such alloys require that the draw die used to form a panel have higher binder tonnage due to the higher yield strength of the material. In addition, panel designs with deeper draw depths require greater forming travel. Increased forming travel adds to the challenges for sheet metal forming processes.

The above operational requirements may result in excessive press impacts and acoustic emissions. Excessive impacts are transmitted through the press structure resulting in frequent press component failure. This problem results from four main components: high stationary equivalent mass (binder tonnage); weak press configuration (point of first contact is earlier in the stroke due to higher binder travel requirements); higher press speeds; and limited time interval requirements for moving the upper die half to accelerate the lower die half immediately after contact. These four components may result in press failure. Press failures result in a subsequent need to repair stamping presses and a substantial loss of production time.

Disadvantages associated with stretch draw, double pad stretch, and inverted toggle dies include high noise levels that are caused in part by engagement by the upper die with the lower binder. When the upper die engages the lower binder, reaction forces are transmitted to the press structure that can lead to fatigue or failure of the press drive.

Applicants' invention is directed to reducing the effects of impulse and momentum that are inherent in stretch draw forming operations. These and other problems are addressed by applicants' invention as summarized below.

SUMMARY OF THE INVENTION

In one embodiment, an apparatus is provided for reducing impact in a press having a binder ring supported on a spring member. As used herein, the term "spring member" should be construed as including an air cushion pad, nitrogen cylinders, mechanical springs, and the like. The press has an upper ram to which an upper die is attached and a stationary press bed that supports a lower die including the binder ring and a stretch forming post. The apparatus comprises a driver cam attached to the ram that has a first driving cam surface on a lower end that is oriented at a first angle. In the initial stroke of the ram, the ram moves the driver downwardly. The apparatus also includes a transverse cam that is attached to the lower die. The transverse cam has a first reaction cam surface that is oriented at a complementary angle to the first angle and is engaged by the first driving cam surface on a first end. The transverse cam shifts horizontally as a result of the first driving surface engaging the first reaction cam surface. The transverse cam also has a second driving cam surface on a second end that is oriented at a second angle. The apparatus also includes a driven cam attached to the binder ring. The driven cam has a second reaction cam surface that is oriented at a complementary angle to the second angle of the transverse cam. The driven cam is engaged by the second driving cam surface so that the driven cam initiates driving the binder ring before the upper die engages the binder.

Other embodiments may include additional optional features, wherein the transverse cam is guided for movement by an elongated slot in the transverse cam that receives a pin that is attached to the lower die. The transverse cam is also retained on a lower die by slide guides that retain the transverse cam on the lower die while limiting movement of the transverse cam to movement in one linear direction. The driven cam moves the lower binder up to 25 mm before the upper die engages the binder.

Other features may comprise orienting the first driving cam surface at a first angle that is less than 40 degrees from vertical. The first angle may also be less than 20 degrees from vertical. The second driving cam surface is oriented at a second angle that is approximately 45 degrees from vertical.

According to another embodiment, a sheet metal forming press is provided that comprises a ram, an upper die that is attached to the ram, a die bed, and a spring support member. The ram reciprocates relative to the die bed. A lower die is attached to the die bed that includes a binder ring and a stretch forming post. The binder ring is supported on the spring support member. When the press moves the ram into engagement with the binder ring, the binder ring opposes the forming stroke with the binder ring that is supported on the spring support member. A pre-engagement accelerator cam set is provided that includes a first cam that is attached to the upper die. The first cam moves vertically with the upper die. The second cam is attached to the lower die that shifts in a non-vertical direction in response to being engaged by the first cam. A third cam is attached to the binder ring and moves vertically against the force of the spring support member. The cam set causes the binder ring to begin moving against the force of the spring support member before the upper die engages the binder ring.

Other embodiments may include additional optional elements, wherein the second cam is retained on the lower die by slide guides that retain the second cam on a lower die while limiting movement of the second cam to movement in one linear direction. The cam set may move the binder ring before the upper die engages the binder. The second cam is guided for movement by an elongated slot in the second cam that receives a pin that is attached to the lower die. The second cam may shift in a horizontal direction in response to being engaged by the first cam.

According to another embodiment, a method is provided for drawing a panel in a sheet metal forming operation. The method comprises providing a sheet metal forming press that has a ram and an upper die attached to the ram. A die bed is provided that supports a lower die. The lower die may include a binder ring and a stretch forming post. The binder ring is supported on a spring support member. A pre-engagement accelerator cam set is provided that includes a first cam attached to the upper die, a second cam attached to the lower die and a third cam attached to the binder ring. The ram is moved with the first cam downwardly in a forming stroke. The first cam engages the second cam and drives the second cam into engagement with a third cam. The binder ring moves downwardly in response to engagement of the third cam by the second cam. Downward movement of the binder ring is opposed by the spring support member. A sheet metal blank is engaged after the step of moving the binder ring downwardly and the sheet metal blank is formed into the desired shape of the drawn panel.

Another aspect of the method of drawing a panel may further comprise clamping the sheet metal blank between the upper die and the binder ring after the binder ring begins to move downwardly. The binder ring may be moved downwardly at a speed that is substantially equal to the speed of the ram or at least approaching that speed.

These and other aspects of the present invention will be better understood in view of the attached drawings and the following detailed description of the illustrated embodiment.

DETAILED DESCRIPTION OF THE PREFERRED EMBODIMENT(S)

Figure 1:
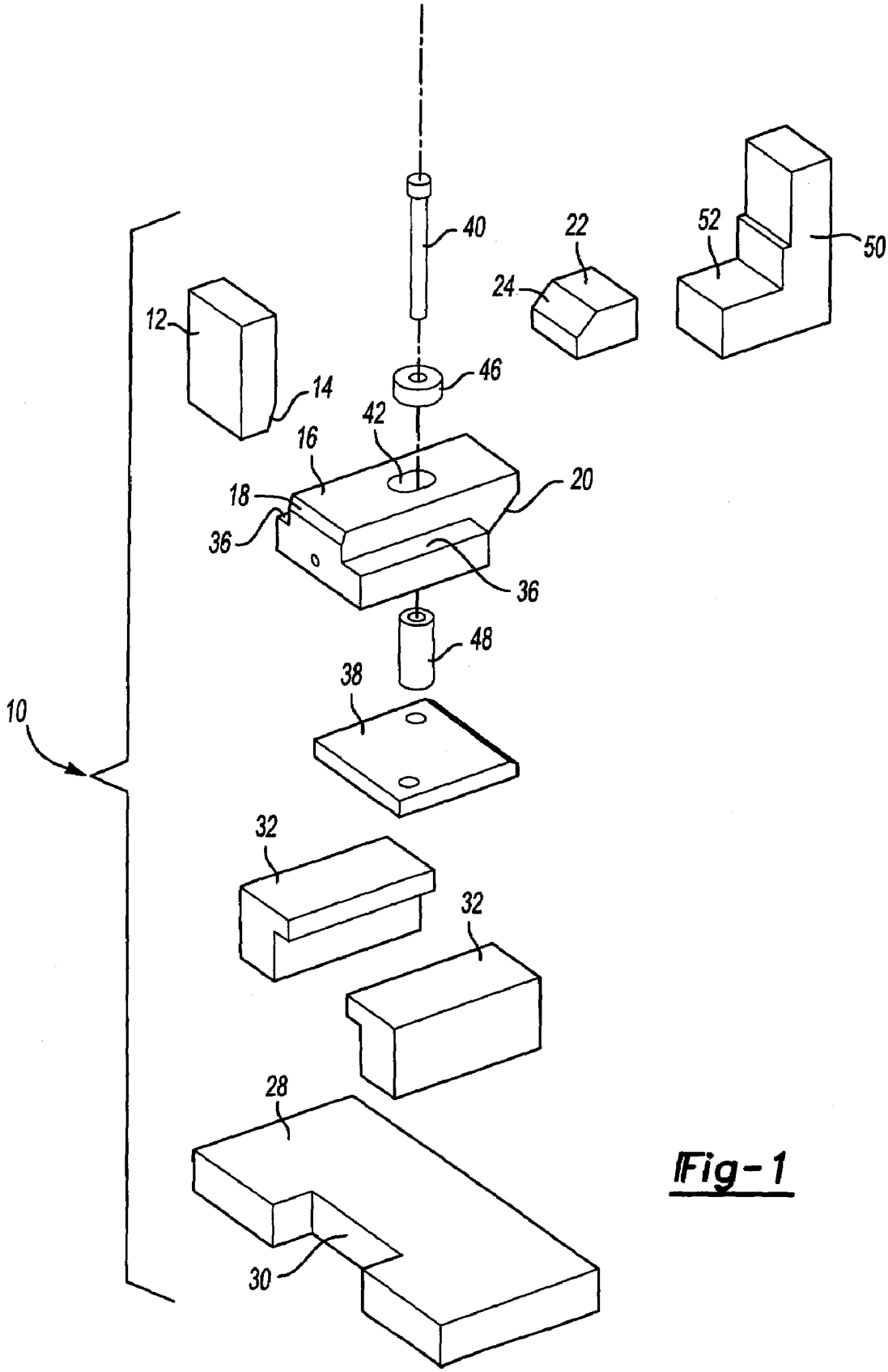
FIG. 1 is an exploded perspective view of a pre-engagement accelerator cam set.

Referring to FIG. 1, an accelerator cam set 10 is shown to include a ram cam block 12 that is attached to the ram of a press (shown in FIGS. 6-8) and has a driving cam surface 14. The ram cam block 12 engages a transverse cam block 16 at a driven cam surface 18. The driving cam surface 14 of the ram cam block 12 engages the driven cam surface 18 of the transverse cam block 16. The transverse cam block 16 moves transversely, or horizontally, in response to engagement of the driven cam surface 18 by the driving cam surface 14. The transverse cam block 16 engages a binder cam block 22 with the driving cam surface 20 engaging a driven cam surface 24 of the binder cam block 22.

The accelerator cam set 10 includes a base 28 on which the transverse cam block 16 is slidably supported. Alternatively, instead of a base 28, the accelerator cam set could be mounted on a support surface of a die. The base 28 has a clearance recess 30 that provides clearance for movement of the ram cam block 12.

Slide guides 32 are secured to the base 28, or other support surface, that are used to guide the transverse cam block 16. The transverse cam block 16 has a pair of shoulders 36 that are engaged by the slide guides 32 to hold the transverse cam block 16 in engagement with the base 28, or supporting surface. A cam base plate 38 is secured to the transverse cam block 16. The transverse cam block 16 is secured for sliding movement relative to the base 28 by a retaining pin 40. The retaining pin 40 is received in an elongated slot 42 formed centrally in the transverse cam block 16. The retaining pin 40 is secured by a locking nut 46 and is also received in a bearing 48.

The binder cam block 22 is secured to a binder support member 50 that secures the binder cam block 22 to the binder of the stretch forming die, as will be more fully described below. A recess 52 is provided in the binder support member 50 which receives the binder cam block 22.

Figure 2:
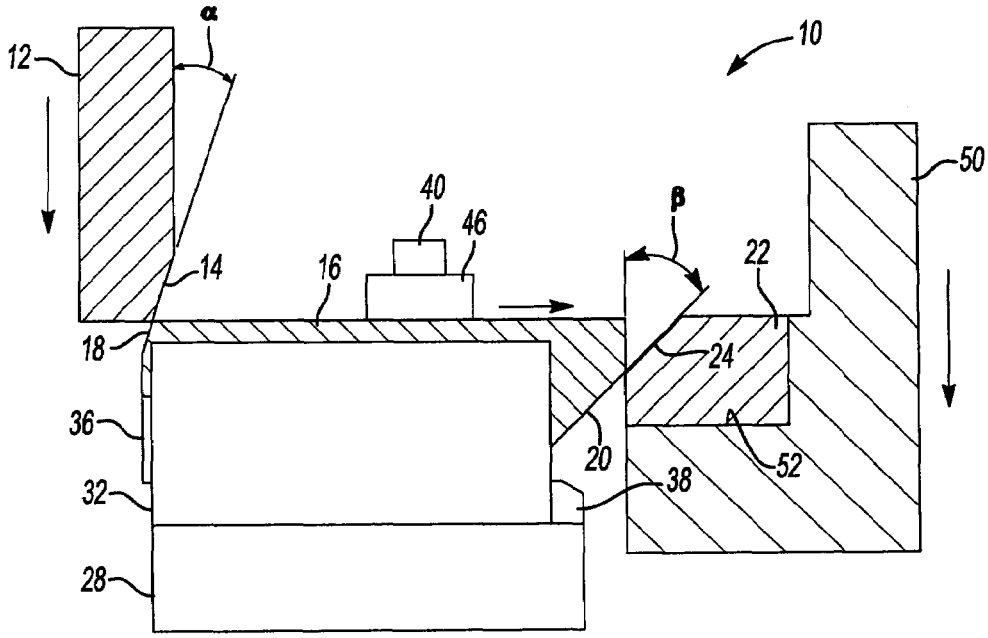
FIG. 2 is a diagrammatic partially cross-section view of the pre-engagement accelerator cam set.

Referring to FIG. 2, operation of the accelerator cam set 10 will be described beginning with the forming stroke of the draw press. The upper die (shown in FIGS. 6-8) supports the ram cam block 12 and moves the cam block 12 downwardly to cause the driving cam surface 14 to engage the driven cam surface 18 of the transverse cam block 16. The direction of movement of the ram cam block 12 is shown by the arrow adjacent to the block 12. The transverse cam block 16 moves to the right, as shown in FIG. 2, in response to engagement by the ram cam block 12 causing the driving cam surface 20 to engage the driven cam surface 24 of the binder cam block 22. Movement of the transverse cam block 16 is represented by the arrow above the transverse cam block 16 in FIG. 2. As the driven cam surface 24 is engaged by the driving cam surface 20, the binder cam block 22 is driven downwardly, as shown by the arrow adjacent to the binder support member 50 in FIG. 2.

The accelerator cam set 10 causes the binder to begin moving downwardly just before the press ram engages the blank of sheet metal that is supported on the binder. The accelerator cam set 10 addresses the negative impacts of high press speeds and limited time interval to increase the speed of the lower half from zero to a speed approaching the speed at which the upper die moves the ram cam block 12. While not essential, the speed of the lower binder ring may equal the speed of the ram at the time of impact. Pre-acceleration ensures minimum relative velocity between the two die halves that cushions the upper die half as it contacts with the lower die. By beginning the downward movement of the binder prior to engagement of the sheet metal panel by the ram, the impact of the ram against the sheet metal panel and binder is reduced resulting in lower noise levels and also resulting in reduced impact and shock to the press that is caused by the ram engaging the binder.

The transverse cam block 16 is secured to the base 28, or another support surface, by retaining pin 40 that is held in place by the locking nut 46. The transverse cam block 16 is limited to reciprocal movement in a single linear direction by the slide guides 32 that capture and restrain the shoulders 36 of the transverse cam block 16. The base 28 and slide guides 32 remain stationary while the transverse cam block 16 shifts in response to engagement by the ram cam block 12. Shifting of the transverse cam block 16 is communicated to the binder cam block 22.

Figure 3:
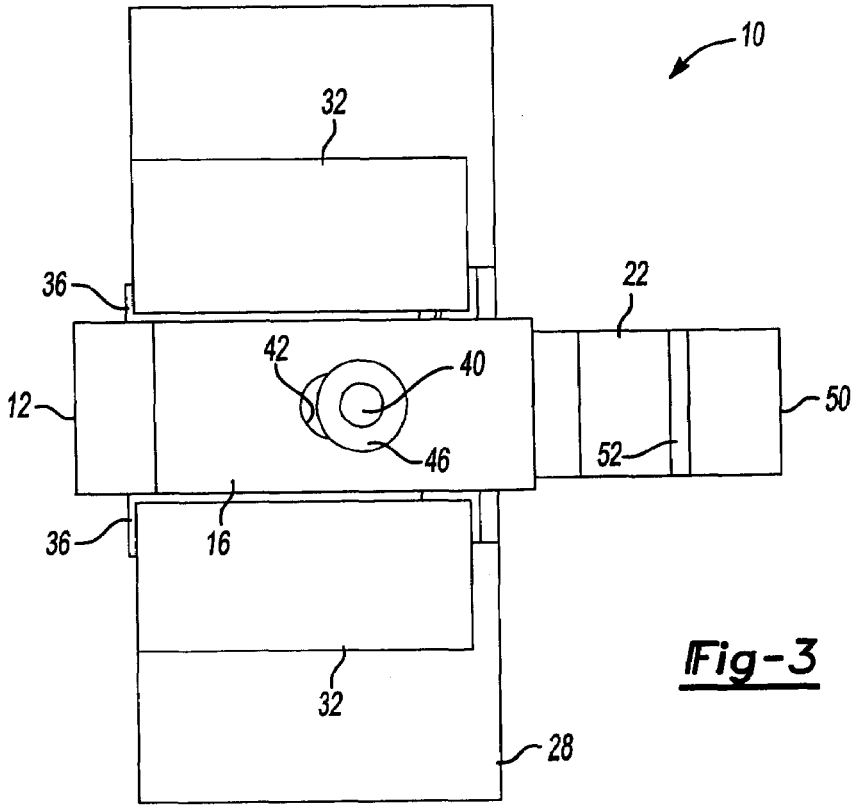
FIG. 3 is a top plan view of the pre-engagement accelerator cam set.
Figure 4:
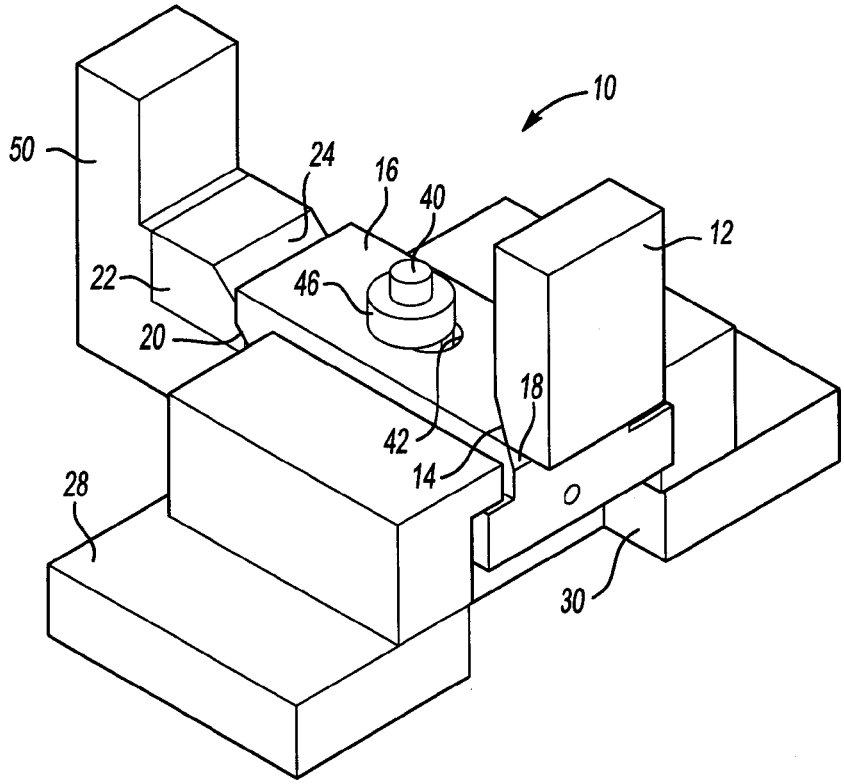
FIG. 4 is a perspective view of the pre-engagement accelerator cam set.
Figure 5:
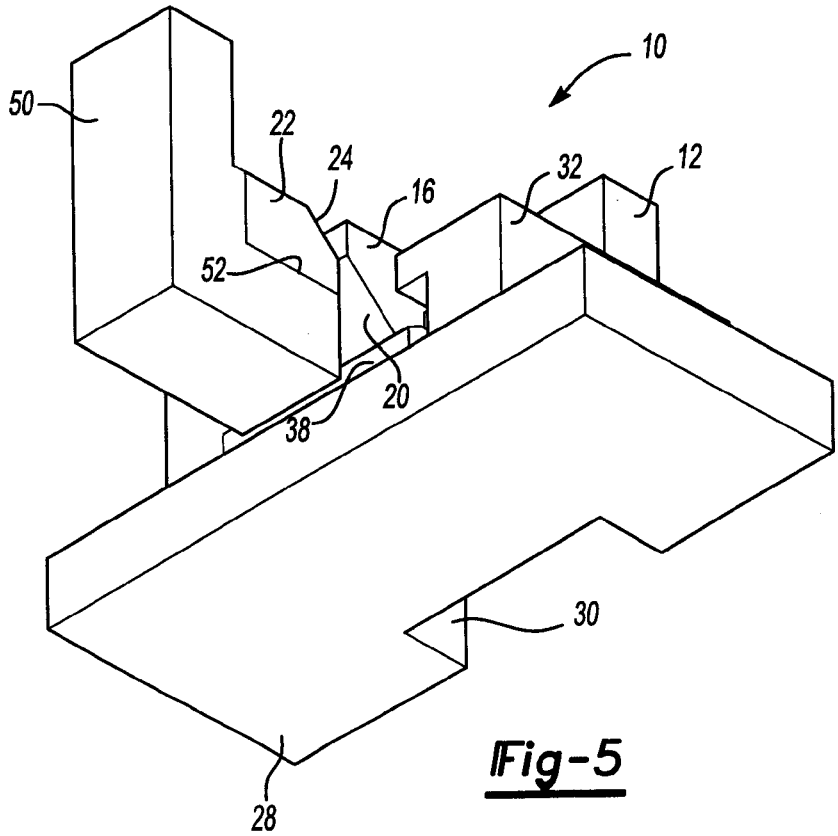
FIG. 5 is a bottom perspective view of the pre-engagement accelerator cam set.

Referring to FIGS. 3-5, the accelerator cam set 10 is shown assembled together on the base 28. The base 28 supports the slide guides 32 that capture and retain the transverse cam block 16 by engaging the shoulders 36. The transverse cam block 16 is further retained by the retaining pin 40 that extends through the elongated slot 42 in the transverse cam block 16 and is held in place by the locking nut 46. Ram cam block 12 is supported on the ram, as will be more fully described below, and is driven into engagement with the driving cam surface 14 engaging the driven cam surface 18 of the transverse cam block 16. The transverse cam block 16 moves in a linear direction into engagement with the binder cam block 22 that is secured to the binder of the stretch draw die.

As shown in FIG. 2, the angle of the driving cam surface 14 relative to vertical is less than 40□ and preferably in the range of approximately 20□ relative to the vertical direction. This angle is denoted as angle α in FIG. 2. The angle of the driven cam surface 18 is a complementary angle to α in the illustrated embodiment which results in the transverse cam block 16 being movable in a horizontal direction. The relationship between angle α of the driving cam surface 14 relative to the driven cam surface 18 could be modified to provide a transverse cam block 16 that moves in a transverse direction that is not strictly horizontal, if desired.

Angle β° is the angle of orientation of the driving cam surface 20 and driven cam surface 24. The preferred angle β is 45°. While other angles could be provided, limiting the angle α to less than angle β results in a reduced level of displacement of the binder cam block 22 in response to a given level of displacement of the ram cam block 12. The ram cam block 12 moves downwardly at a greater rate than the binder cam block 22 along the binder cam block 22 to begin accelerating the binder downwardly. This spreads the impact of the ram against the binder over time resulting in reduced shock loading.

Figure 6:
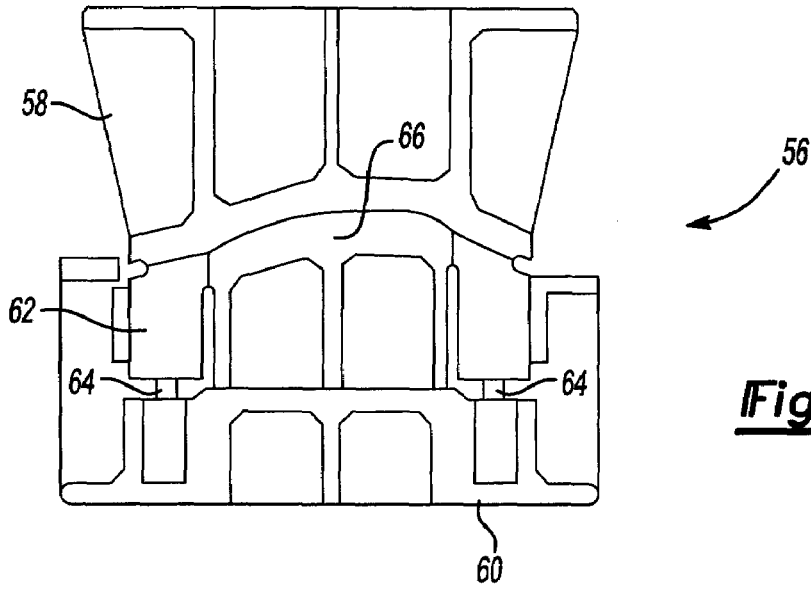
FIG. 6 is a front elevation view of a stretch draw die.

Referring to FIG. 6, a stretch draw die 56 is schematically illustrated. The accelerator cam set 10 may be incorporated in the structure of a stretch draw die 56. The stretch draw die 56 includes an upper die 58 and a lower die 60. The lower die 60 includes a lower binder ring 62 that is supported on a plurality of spring biased pins 64. The spring biased pins 64 may be nitrogen cylinders, an air pad, or a mechanical spring. For forming high strength sheet metal parts, nitrogen cylinders are preferably used due to the greater tonnage that may be achieved by the use of nitrogen cylinders. The lower die also includes a lower draw post 66 over which the sheet metal blank is drawn. The sheet metal blank is drawn after the upper die 58 contacts the lower binder ring 62. The impact of the upper die 58 engaging the lower binder ring 62 causes substantial noise and impact that must be absorbed by the stretch draw die 56 structure. This impulse may result in damage to the press. The accelerator cam set 10 is interposed between the upper die 58 and the lower die 60 so that the lower binder ring 62 will begin moving downwardly away from the upper die 58 just prior to the upper die 58 engaging the blank and the lower binder ring 62. The ram cam block 12 is secured to the upper die 58 while the transverse cam block 16 is secured to the lower die 60. The binder cam block 22 is secured to the lower binder ring 62.

Figure 7:
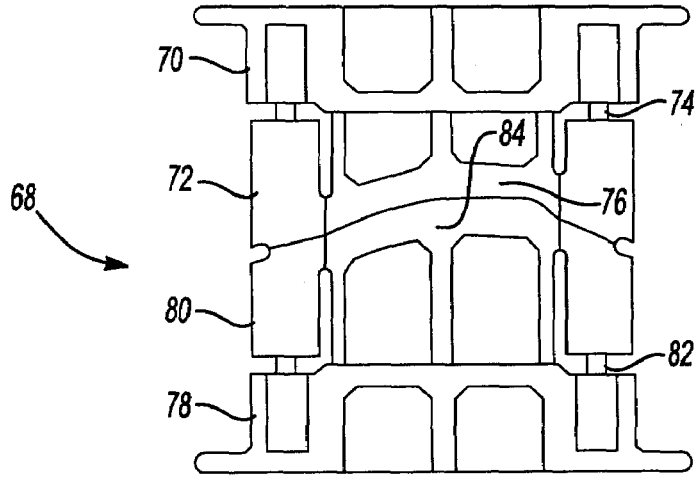
FIG. 7 is a front elevation view of a double pad stretch draw die.

Referring to FIG. 7, an accelerator cam set 10 may also be incorporated in a double pad stretch draw die 68. This type of stretch draw die 68 includes an upper die shoe 70 and an upper die binder ring 72. The upper die binder ring 72 is supported on a set of upper spring biased pins 74 for movement relative to an upper draw punch 76. Lower die shoe 78 includes a lower binder ring 80 that is supported on lower spring biased pins 82 for movement relative to a lower draw post 84. The double pad stretch draw die 68 permits drawing a panel into both the upper die shoe 70 and the lower die shoe 78 across the upper draw punch 76 and lower draw post 84. The accelerator cam set 10, as previously described, may be secured between the upper die binder ring 72 and lower die shoe 78. An additional set of accelerator cam sets may be provided between the lower binder ring 80 and the upper die shoe 70.

Figure 8:
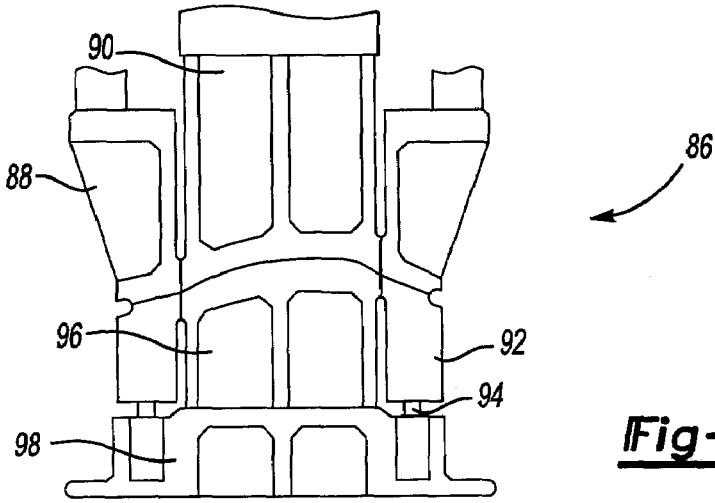
FIG. 8 is a front elevation view of an inverted toggle die.

Referring to FIG. 8, an inverted toggle die 86 is illustrated in which the accelerator cam set 10 may be incorporated. The inverted toggle die 86 includes an upper binder ring 88 that is disposed about upper draw punch 90. A lower binder ring 92 is supported on spring biased pins 94 for movement relative to a lower draw post 96. The accelerator cam set 10 may be mounted to the lower die shoe 98 so that the lower binder ring 92 begins moving before the upper binder ring 88 is driven into contact with the sheet metal blank and the lower binder ring 92. By accelerating the lower binder ring 92 prior to engagement with the upper binder ring 88, the force of engagement may be spread over time and less noise will be generated by the forming operation. In addition, the impact, according to the principle of impulse and momentum, is reduced resulting in reduced shock to the inverted toggle die 86.

While the best mode for carrying out the invention has been described in detail, those familiar with the art to which this invention relates will recognize various alternative designs and embodiments for practicing the invention as defined by the following claims.

What is claimed:

1. An apparatus for accelerating a press having an upper ram to which an upper die is attached, and a stationary press bed that supports a lower die including a binder ring and a stretch forming pad comprising:

a driving cam attached to the ram and having a first driving cam surface on a lower end that is oriented at a first angle, wherein the ram has a forming stroke in which the ram moves the driving cam downwardly;

a transverse cam attached to the lower die, the transverse cam having a first reaction cam surface that is oriented at a complimentary angle to the first angle and is engaged by the first driving cam surface on a first end, wherein the transverse cam shifts horizontally as a result of the first driving surface engaging the first reaction cam surface, the transverse cam having a second driving cam surface on a second end that is oriented at a second angle; and a driven cam attached to the binder ring, the driven cam having a second reaction cam surface that is oriented at a complimentary angle to the second angle and is engaged by the second driving cam surface, wherein the driven cam starts to drive the binder ring before the upper die engages the binder.

2. The apparatus of claim 1 wherein the transverse cam is guided for movement by an elongated slot in the transverse cam that receives a pin that is attached to the lower die.

3. The apparatus of claim 1 wherein the transverse cam is retained on the lower die by slide guides that retain the transverse cam on the lower die while limiting movement of the transverse cam to movement in one linear direction.

4. The apparatus of claim 1 wherein the driven cam moves the binder ring up to 25 mm before the upper die engages the binder ring.

5. The apparatus of claim 1 wherein the driven cam is accelerated to the speed of the driving cam before the upper die engages the binder ring.

6. The apparatus of claim 1 wherein the first driving cam surface is oriented at a first angle that is less than 40 degrees from vertical.

7. The apparatus of claim 1 wherein the first driving cam surface is oriented at a first angle that is less than 20 degrees from vertical.

8. The apparatus of claim 1 wherein the second driving cam surface is oriented at a second angle that is approximately 45 degrees from vertical.

9. A sheet metal forming press comprising:

a ram;

an upper die attached to the ram;

a die bed relative to which the ram reciprocates;

a lower die attached to the die bed, the lower die including a binder ring and a stretch forming post, wherein the binder ring is supported on a spring support member, wherein the press moves the ram on a forming stroke into engagement with the binder ring that is opposed by the spring support member;

a pre-engagement accelerator cam set including a first cam attached to the upper die that moves vertically with the upper die, a second cam attached to the lower die that shifts in a non-vertical direction in response to being engaged by the first cam, a third cam attached to the binder ring that moves vertically against the force of the spring support, wherein the cam set causes the binder ring to begin moving against the force of the spring support member before the upper die engages the binder ring.

10. The sheet metal forming press of claim 9 wherein the second cam is retained on the lower die by slide guides that retain the second cam on the lower die while limiting movement of the second cam to movement in one linear direction.

11. The sheet metal forming press of claim 9 wherein the cam set moves the binder ring up to 25 mm before the upper die engages the binder ring.

12. The sheet metal forming press of claim 9 wherein the second cam is guided for movement by a an elongated slot in the second cam that receives a pin that is attached to the lower die.

13. The sheet metal forming press of claim 9 wherein the second cam shifts in a horizontal direction in response to being engaged by the first cam.

14. The sheet metal forming press of claim 9 wherein the first cam has a cam surface that is oriented at a first angle that is less than 40 degrees from vertical.

15. The sheet metal forming press of claim 9 wherein the first cam has a cam surface that is oriented at a first angle that is less than 20 degrees from vertical.

16. The sheet metal forming press of claim 9 wherein the second cam has a cam surface that is oriented at a second angle that is approximately 45 degrees from vertical.

17. A method of drawing a panel in a sheet metal forming operation, the method comprising:

providing a sheet metal forming press having a ram, an upper die attached to the ram, a die bed relative to which the ram reciprocates, and a lower die attached to the die bed, the lower die including a binder ring and a stretch forming post, wherein the binder ring is supported on a spring support member;

providing a pre-engagement accelerator cam set including a first cam attached to the upper die, a second cam attached to the lower die, and a third cam attached to the binder ring;

moving the ram and the first cam downwardly on a initial stroke;

engaging the second cam with the first cam;

driving the second cam into engagement with the third cam;

moving the binder ring downwardly in response to the engagement of the third cam by the second cam, wherein the downward movement of the binder ring is opposed by the spring support member;

engaging a sheet metal blank after the step of moving the binder ring downwardly; and forming the sheet metal blank to form a drawn panel.

18. The method of claim 17 further comprising clamping the sheet metal blank between the ram and the binder ring after the binder ring is moved downwardly.

19. The method of claim 17 further comprising moving the binder ring downwardly at a speed that approaches the speed at which the ram moves the first cam.

* * * * *